US006374458B1

(12) United States Patent
Finkelstein

(10) Patent No.: US 6,374,458 B1
(45) Date of Patent: Apr. 23, 2002

(54) ANTI-SAG HINGE FOR COMMERCIAL REFRIGERATOR AND FREEZER DOORS

(76) Inventor: Burl M. Finkelstein, 57 Amlajack Blvd., Shenandoah, GA (US) 30265

( * ) Notice: Subject to any disclaimer, the term of this patent is extended or adjusted under 35 U.S.C. 154(b) by 0 days.

(21) Appl. No.: 09/420,331

(22) Filed: Oct. 18, 1999

(51) Int. Cl.[7] ..... E05D 7/04; E05F 1/02
(52) U.S. Cl. ..... 16/235; 16/247; 16/309
(58) Field of Search ..... 16/235, 247, 309, 16/312, 250, 251; 312/326

(56) References Cited

U.S. PATENT DOCUMENTS

| | | | | | |
|---|---|---|---|---|---|
| 3,229,323 | A | * | 1/1966 | Hensgen | 16/247 |
| 3,263,368 | A | * | 8/1966 | Hildum et al. | 16/247 |
| 3,748,688 | A | * | 7/1973 | Berkowitz | 16/247 |
| 3,975,794 | A | * | 8/1976 | Kaiser et al. | 16/309 |
| 4,215,449 | A | * | 8/1980 | Loikitz | 16/309 |
| 4,639,971 | A | * | 2/1987 | Kurtz | 16/247 |
| 5,788,351 | A | * | 8/1998 | Prunty et al. | 16/243 |

FOREIGN PATENT DOCUMENTS

| | | | | | |
|---|---|---|---|---|---|
| GB | 0004181 | * | 3/1900 | | 16/309 |
| JP | 404070480 | A | * | 3/1992 | 16/235 |
| JP | 405222878 | A | * | 8/1993 | 16/235 |

* cited by examiner

*Primary Examiner*—Chuck Y. Mah
(74) *Attorney, Agent, or Firm*—Kilpatrick Stockton LLP

(57) ABSTRACT

An anti-sag hinge is disclosed that provides an adjustment plate to facilitate alignment of a commercial refrigerator or freezer door to an associated cabinet. The invention includes a strap assembly and a mounting flange that cooperate to effect opening and closing of the door. The adjustment plate of the preferred hinge cooperates with either of strap assembly or the mounting flange to permit internal adjustment of the door relative to the cabinet.

1 Claim, 3 Drawing Sheets

ANTI-SAG HINGE FOR COMMERCIAL REFRIGERATOR AND FREEZER DOORS

TECHNICAL FIELD

The present invention relates to hinges for commercial reach-in refrigerators and freezers. More particularly, the present invention relates to an anti-sag hinge for surface mounted doors that facilitates internal adjustment for alignment compensation.

BACKGROUND OF THE INVENTION

It has become commonplace to offer refrigerated products directly to the public in a variety of stores. For example, roadside convenience stores and gas stations have long offered refrigerated drinks in ice buckets and other readily accessible devices whereby the individual selected and obtained the drink or other refrigerated item without assistance. A preferred method of self service delivery of such products has become to provide one or more publicly accessible refrigerators or freezers that both present the drink (or other refrigerated product) and serve to dispense it as well. Thus, an individual may enter a convenience store and find an entire wall of refrigerated cabinets. Each cabinet is provided with one or more display devices that facilitate storage and retrieval of a multitude of products, ranging from soft drinks to dairy products such as ice cream and other consumer food products. The individual thus opens the door to the refrigerator or freezer and "reaches-in" to retrieve the desired item. This arrangement has been very successful. Accordingly, more and different establishments are providing such refrigerators and freezers. For example, one may encounter reach-in refrigerators and freezers in airport concession stores, sandwich shops, restaurants, schools, hospitals, sports arenas, office buildings, and almost any other type of commercial establishment where a demand exists for ready access to refrigerated products.

It is to be appreciated that reach-in refrigerators and freezers are typically provided in high-use situations. As a result, the refrigerator and freezer doors are repeatedly opened and closed by many different people. For example, a convenience store reach-in refrigerator door may be opened and closed by persons of all ages, ranging from young children to the elderly. Many such individuals are careless with or inadvertently misuse the refrigerator door. For example, a young child may hang on the door while it closes. A person may lean against an open refrigerator door for physical support. A person may exert a downward force on the refrigerator door handle for any number of reasons. Of course, classic wear and tear on the door as a result of frequent use may cause the door to become mis-aligned on its hinges. As a result, the door itself "sags" or becomes mis-aligned with the jamb.

Thus, it is known that doors of commercial reach-in refrigerators sag and lose proper alignment with their respective opening of a refrigerator or freezer cabinet. It is further known that even new doors, due to manufacturing tolerances of either the door, the cabinet, or both, may not properly align with the opening. As a result, various prior art methods have been devised to correct for such sag and misalignment, including shimming, remounting the hinge and distorting the cabinet. However, each of these methods offered only an external method of addressing the mis-alignment problem. Prior to the present invention, there was no apparatus or method that provided internal hinge adjustment for alignment or sag compensation.

Accordingly, there is a need in the art for an apparatus and method for compensating for the sag or misalignment of reach-in refrigerator and freezer doors that is internal to the door hinge.

SUMMARY OF THE INVENTION

The present invention fills the above-described need in the prior art by providing a anti-sag hinge for high use commercial refrigerator and freezer applications. Unlike previous devices and methods for addressing the mis-alignment problems in such doors, the present invention provides for internal hinge adjustment for alignment compensation or sag.

Briefly described, the present invention provides an internal adjustment plate to combat misalignment or sag in the door of a commercial reach-in refrigerator or freezer.

Described somewhat more particularly, the present invention comprises an improved hinge for reach-in refrigerators and freezers. In a preferred form, the present invention comprises a mounting bracket, a strap assembly, and an adjustment plate that cooperate to mount and sustain a refrigerator or freezer door and, when sagging or misalignment occur, provide for correction thereof by manipulation of the adjustment plate to realign the door within the jamb of the refrigerator or freezer cabinet jamb.

Thus, it is an object of the present invention to provide an anti-sag hinge for commercial reach-in refrigerators and freezers.

It is a further object of the present invention to provide an anti-sag hinge for commercial reach-in refrigerators and freezers that addresses the misalignment problems caused by repeated opening and closing of the associated door.

It is a further object of the present invention to provide an anti-sag hinge for commercial reach-in refrigerators and freezers that includes an internal adjustment feature to correct misalignment of the door within the cabinet.

It is a still further object of the present invention to provide an anti-sag hinge for a commercial reach-in refrigerator or freezer door that can affect alignment correction without shimming, remounting of the hinge or distortion of the cabinet.

It is a still further object of the present invention to provide an anti-sag hinge for a commercial reach-in refrigerator door that meets the present standards of the National Sanitation Foundation.

These and other objects, features and advantages of the present invention will become apparent from a reading of the following detailed description of the preferred embodiments in conjunction with the appended drawings.

DETAILED DESCRIPTION

Figure 1:
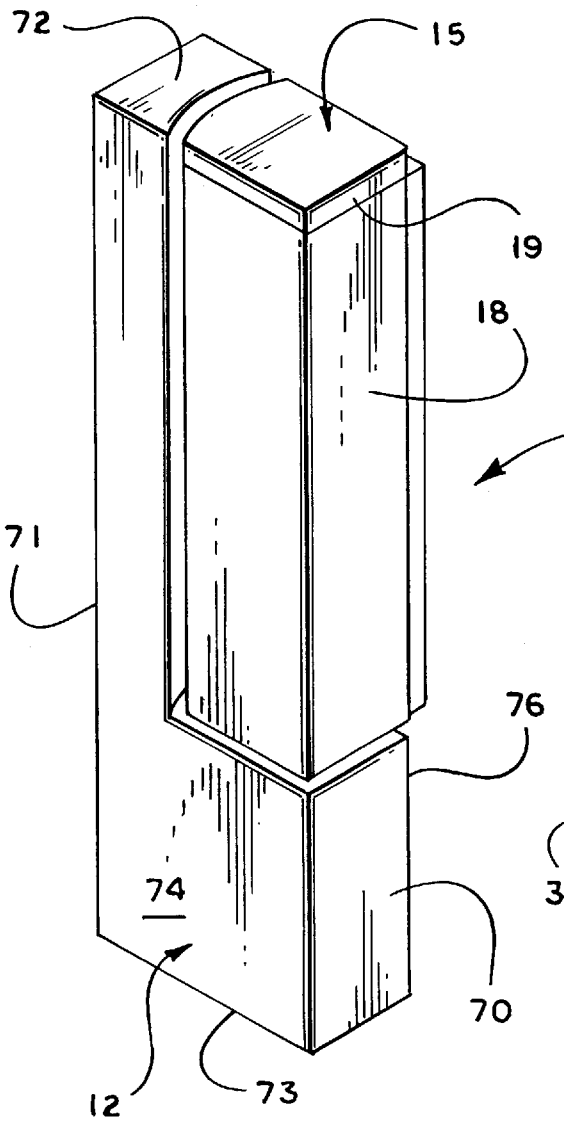
FIG. 1 is a perspective view of a preferred embodiment of the present invention.

Referring now in more detail to the drawings, in which like numerals indicate like parts throughout the several views, FIG. 1 shows a preferred anti-sag hinge 10 according to the present invention. The hinge 10 includes a mounting flange 12, a strap assembly 15 and a cover plate 18. The cover plate 17 is a generally U-shaped member that may be made of any suitable material and finish, including steel, aluminum and plastic. The cover 17 is provided for many reasons, including aesthetics and to meet the sanitary requirements employed in the industry as specified by the National Sanitation Foundation. Thus, those of ordinary skill in the art will appreciate that the cover plate 17 serves to prevent food or dirt particles and the like from reaching the inner-workings of the hinge 10. Such areas would be otherwise uncleanable.

It is to be appreciated that the hinge 10 shown in the drawings is an edgemount, cam-rise hinge that, as described in detail hereinbelow, is specially configured for use with a reach-in refrigerator or freezer door. The cabinets for which such doors are intended are well-known in the art and need not be disclosed further herein. It is to be further appreciated that the hinge 10, either alone or in combination with another hinge in accordance with the present invention, support a door (not shown) in the usual manner. Thus, for example, the door of a reach-in refrigerator supported by a hinge 10 constructed in accordance with the present invention may be lifted directly off the hinge for purposes of adjustment or as otherwise necessary.

Figure 2:
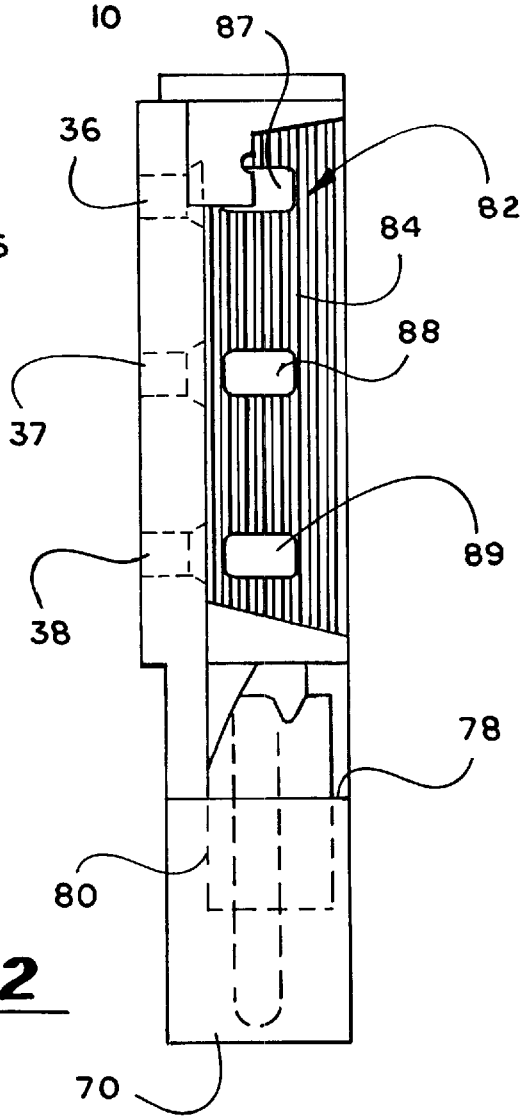
FIG. 2 is a front section view of a preferred embodiment of the present invention.
Figure 4:
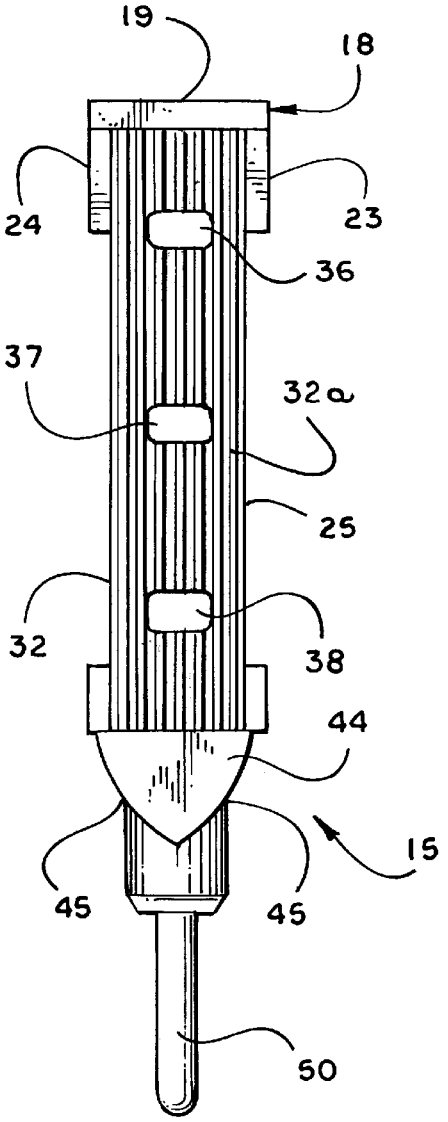
FIG. 4 is a side view of the strap assembly shown in FIG. 3.
Figure 3:
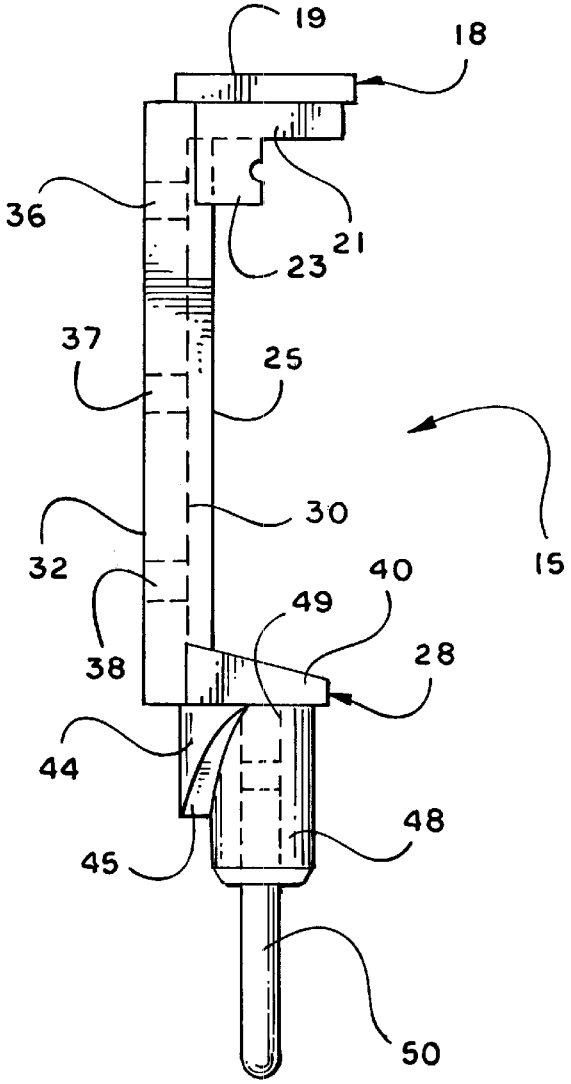
FIG. 3 is a side section view of a preferred strap assembly according to the present invention shown in FIG. 1.

FIG. 2 shows the mounting flange 12 and the strap assembly 15 of the preferred hinge 10 in greater detial. FIGS. 3 and 4 show the strap assembly 15 in isolation. Referring to FIGS. 2 and 3, the strap assembly 15 includes a crown 18 having a top surface 19 and an open brim 21. The brim 21 is forced integrally with supports 23 and 24. the supports 23 and 24 depend from and are located at the top of a strap 25. The strap 25 extends between the crown 18 and a strap 25. The strap 25 extends between the crown 18 and a strap base 28. The strap 25 is substantially rectangular in shape and defines an inner surface 30 and an outer surface 32. The inner surface 30 defines a plurality of raised or serrated edges 30*a*. The outer surface 32 defines a crisscrossed, raised surface edges 32*a*. The strap 25 defines three openings 36, 37 and 38 which are referenced in greater detail hereinbelow.

The foot assembly 28 provides a base 40 that projects from the strap 25 in a manner similar to the crown 18. It is to be understood that the cover plate 18 is configured for mating and frictional engagement with the crown 18 and the foot assembly 28 to protect the interior of the hinge 10. More particularly, the cover plate 17 fits snuggly about surfaces 21 and 23 of the crown 18 and base surface 40 of the foot assembly 28 to be fixedly retained to the hinge 10. The foot assembly includes a downwardly projecting cam element 44 defining a cam surface 45. The cam element 44 is formed integrally with aid projects downwardly of the base 40. The foot assembly further includes a cylindrical axle portion 48. As described in more detail below, the axle portion 48 of the strap assembly 15 rests and is rotatable within a cam 60. The cylindrical axle portion 48 of the strap assembly defines a cylindrical opening 49 through the middle of the axle. The opening 49 is configured to receive a knurled pin 50 that is frictionally captured within the axle, and therefore, rotates in tandem with the strap assembly 15 as described below.

FIG. 2 further shows the interior of the mounting flange 12, which includes a front surface 70, a back surface 71, a top surface 72, a bottom surface 73, a side 74 and another side 76. The mounting flange includes a shelf 78 that defines an opening 80 for receipt of the cam 60. The cam 60 is fixedly retained within the opening 80. The flange 12 further includes an interior wall surface 82 that is preferably serrated with ridges 84. The back surface 71 and the interior surface 82 define three openings 87, 88 and 89. These openings facilitate mounting of the hinge 10 as described below.

Figure 5:
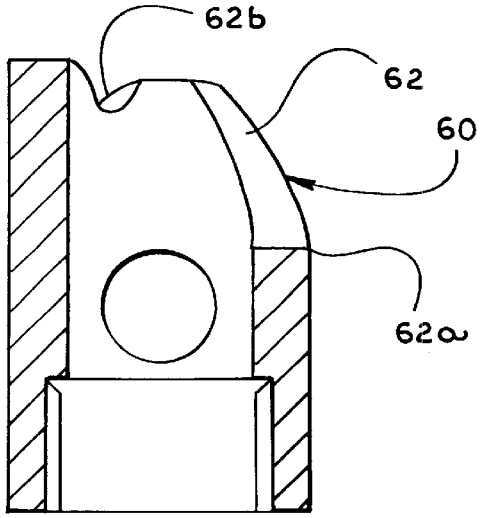
FIG. 5 is a side view of the cover used in the preferred embodiment shown in FIG. 1.

The preferred hinge 10 shown in the drawings further includes a cam 60, and is shown in isolation in FIG. 5. The cam 60 defines a first or closed, "at rest" cam surface 62. It will be appreciated that the cam surface 62 is configured to retain fully the downwardly projecting portion 44 of the strap assembly 15. Thus, cam surface 62 engages cam surface 45 when the door (not shown) is closed or in an "at rest" position, shown at 62*a*. Further, cam surface 62 defines a second "at rest" or open position 62*b*. It is to be understood that when the refrigerator or freezer door is opened, the cam surface 45 of the strap assembly 15 is moved along cam surface 62 from point 62*a* to 62*b*. It is to be further understood that the cam surface 62*b* defines a detent or second "at rest" point, such that the hinge 10 has been manipulated to that point 62*b*, the door will remain open at that position.

Figure 6:
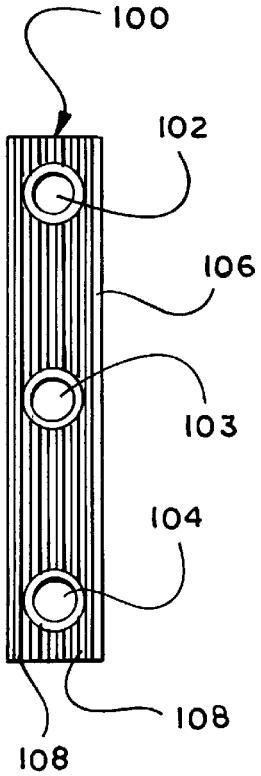
FIG. 6 is a plan view of an adjustment plate of the preferred embodiment shown in FIG. 1.
Figure 7:
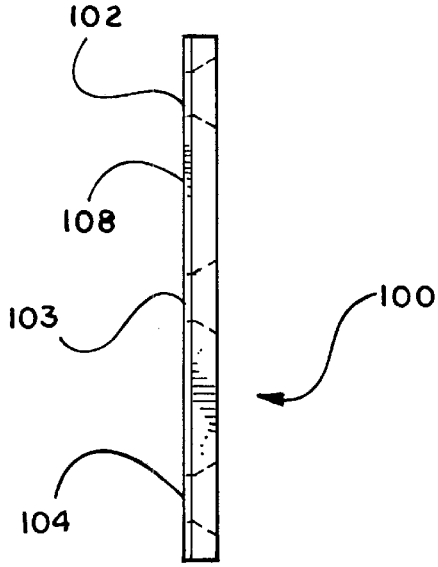
FIG. 7 is a side view of the adjustment plate shown in FIG. 6.

The preferred hinge 10 further includes as least one adjustment plate 100, shown in isolation in FIGS. 6 and 7. Referring thereto, the preferred adjustment plate is configured to fit within the hinge 10 between the crown assembly 18 and the foot assembly 28 (see FIG. 2). More particularly, an adjustment plate 100 may be secured within the hinge 10 against interior surface 30 of the strap assembly 15 or the interior surface 82 of the mounting flang 12. Such securing of either or both adjustment plates (since the adjustment plates are otherwise identical, only one is described herein in detail) is accomplished by means of three openings 102, 103 and 104 defined in the adjustment plate 100. The openings 102, 103 and 104 are configured to cooperate with openings 36, 37 and 38 in surface 30 of the strap assembly 15 and openings 87, 88 and 89 in the mounting flange 12. These openings are all preferably sized to accommodate number 12 flat head screws (not shown), which are commonly used to support reach-in refrigerator and freezer doors. The adjustment plate 100 provides a back side 106 that is characterized by a plurality of raised serrations 108. It is to be further understood that the backside 106 is to be placed against the interior surfaces of either the mounting flange 12 or the strap assembly 15. It is to be further understood that the openings 102, 103 and 104 are configured to receive flat head screws so that in a flush mounted manner. Thus, each opening 102–104 is expanded at its upper end to receive the head of such a screw. Yet further, it is to be appreciated that the openings 102–104 are circular in configuration, whereas the openings 82–84 in the mounting flange 12 and the openings 36–38 in the strap assembly 15 are slotted in configuration. As described below, such configurations provide for the internal adjustment necessary to effect correction of door mis-alignment.

In use of the present invention, the hinge 10 is mounted to the refrigerator or freezer door in the conventional manner as is well known in the art. The mounting flange 12 is secured to the jamb by the use of screws (not shown) that extend between the flange and the cabinet. However, in accordance with the present invention, the screws first extend through openings 102, 103 and 104 in the adjustment plate 100 placed against interior surface 82. The screws next extend through the openings 87, 88 and 89, respectively, to engage the cabinet jamb (not shown). The adjustment plate 100 is preferably initially in a true vertical alignment so as to be centered within the mounting flange 12. A conventional reach-in refrigerator or freezer door is similarly secured to the hinge 10 by three screws (not shown) the extend through an adjustment plate and the openings 36, 37 and 38 in the strap assembly 15. Once again, the adjustment plate 100 secured against the interior surface 30 of the strap assembly is preferably in a true vertical alignment so as to be centered within the strap assembly 15. However, as is known in the art, the cabinet or the door or both may not be true due to manufacturing tolerances, damage to either or other reasons. Accordingly, the installer may adjust for such discrepancies by manipulating the position of the adjustment plate 100 within the hinge 10. More particularly, the installer may move the adjustment plate 100 as necessary within the hinge to the extent permitted by the slotted openings 36–38 or 87–89 to facilitate proper alignment of the door to the cabinet. In like fashion, in the event that proper alignment of the door is disturbed as a result of use, the installer need only remove the cover plate 17 to gain access to the interior of the hinge 10 and then manipulate either adjustment plate 100 to effect correction of the alignment. More particularly, the installer would need only to loosen the appropriate screws to permit manipulation of the door. Then, once the door was moveable but yet still support by the hinge, the installer could position the door so as to align it to the cabinet, and then re-tighten the screws to secure the doors position and corrected alignment.

Thus, the present invention fulfills the need in the art for an apparatus and method for compensating for the sag or misalignment of reach-in refrigerator and freezer doors that is internal to the door hinge. This need is fulfilled by providing an anti-sag hinge for commercial reach-in refrigerator or freezer doors that includes an adjustment plate 100 that permits correction of alignment both during initial installation of the door to the cabinet and realignment of the door due to frequent opening and closing of such doors.

While this invention has been described in detail with particular reference to the preferred embodiments thereof and the best mode of practicing same, it will be understood that variations and modifications can be effected within the spirit and scope of the invention as described hereinabove and as set forth in the appended claims.

I claim:

1. An anti-sag hinge for commercial refrigerator and freezer doors, such doors being suited for mating engagement with an associated cabinet and jamb, the invention comprising:

a mounting flange for attachment to a cabinet jamb, said mounting flange comprising a surface for mating engagement with said cabinet, said mating surface defining at least one slot for receipt of a mounting screw;

a strap assembly for rotation relative to said mounting flange, said strap assembly including a crown, a foot and an internal surface therebetween, said strap assembly further defining at least one slot for receipt of a mounting screw within said internal surface for mounting of a door to said cabinet;

a first adjustment plate defining at least one opening corresponding to said mounting flange slot, said adjustment plate being configured so as to rest entirely within said mounting flange;

a second adjustment plate defining at least one opening corresponding to said strap assembly slot, said adjustment plate being configured so as to rest entirely within said strap assembly, whereby, by manipulation of either said first adjustment plate relative to said mounting flange or said second adjustment plate relative to said strap assembly, the adjustment of a door relative to said cabinet jamb can be adjusted by an internal hinge adjustment; and a cover plate disposed between said crown and foot of said strap assembly so as to preclude access to the interior of said hinge.

* * * * *